US006490882B2

(12) United States Patent
Tipton

(10) Patent No.: US 6,490,882 B2
(45) Date of Patent: Dec. 10, 2002

(54) METHOD AND APPARATUS FOR MAINTAINING COMPRESSOR DISCHARGE VAPOR VOLUME FOR STARTING WITH CONDENSING UNIT AMBIENT TEMPERATURES LESS THAN EVAPORATOR UNIT AMBIENT TEMPERATURES

(75) Inventor: Russ Tipton, Westerville, OH (US)

(73) Assignee: Liebert Corporation, Columbus, OH (US)

( * ) Notice: Subject to any disclaimer, the term of this patent is extended or adjusted under 35 U.S.C. 154(b) by 0 days.

(21) Appl. No.: 09/818,801

(22) Filed: Mar. 27, 2001

(65) Prior Publication Data

US 2002/0139137 A1 Oct. 3, 2002

(51) Int. Cl.[7] ..... F25B 1/00
(52) U.S. Cl. ..... 62/498; 62/467; 62/324.1
(58) Field of Search ..... 62/498, 467, 324.1, 62/160, DIG. 17, 182

(56) References Cited

U.S. PATENT DOCUMENTS 2,705,404 A * 4/1955 Malutich ..... 62/DIG. 17
4,638,643 A * 1/1987 Sakazume et al. ..... 62/209
4,785,639 A * 11/1988 Biagini ..... 62/132
5,230,222 A * 7/1993 Erbs ..... 62/192

* cited by examiner

*Primary Examiner*—William C. Doerrler
(74) *Attorney, Agent, or Firm*—Howrey Simon Arnold & White LLP

(57) ABSTRACT

A method of preventing refrigerant condensation in a discharge volume or discharge line of a compressor is disclosed. The method involves the application of one or more heaters to a cooling circuit to prevent condensed refrigerant from migrating into the discharge line and/or discharge volume of the compressor. In one embodiment, a heater is in thermal communication with the dome of the compressor. The heater may be a band heater. In another embodiment, a flexible strip heater is used on the discharge line of the cooling circuit. In another embodiment, both a heater on the discharge volume of the compressor and a heater on the discharge line may be used to prevent migration and condensation of refrigerant.

11 Claims, 8 Drawing Sheets

METHOD AND APPARATUS FOR MAINTAINING COMPRESSOR DISCHARGE VAPOR VOLUME FOR STARTING WITH CONDENSING UNIT AMBIENT TEMPERATURES LESS THAN EVAPORATOR UNIT AMBIENT TEMPERATURES

BACKGROUND OF THE INVENTION

The present invention relates generally to a method of preventing refrigerant condensation in a discharge volume or discharge line of a compressor, and, more particularly to the application of one or more heaters to a cooling circuit to prevent condensed refrigerant from migrating into the discharge line and/or discharge volume of a compressor.

Electronic equipment in a computer or telecommunication room requires precise, reliable control of room temperature, humidity and airflow. Excessive heat or humidity can damage or impair the operation of critical computer systems and other components. For this reason, precision cooling systems are operated to provide cooling in these situations.

A typical cooling system 10 is schematically illustrated in FIG. 1. The cooling system 10 includes compressor 20, condenser 30, expansion valve 50 and evaporator 60. Refrigerant for use in the cooling system 10 may be any chemical refrigerant, such as chloroflourocarbons (CFCs), hydroflourocarbons (HFCS) or hydrochloroflourocarbons (HCFCs) such as R-22.

Operation of cooling system 10 is as follows. Refrigerant is compressed in a compressor 20, which may be a reciprocating or scroll compressor or other compressor type. After the refrigerant is compressed, it travels through a discharge line 12 to a condenser 30. A high head pressure switch 24 is attached to discharge line 12. High head pressure switch 24 shuts down the compressor if the discharge pressure exceeds a predetermined level.

In condenser 30, heat from the refrigerant is dissipated to an external heat sink, e.g., the outdoor environment. Upon leaving condenser 30, refrigerant passes through a liquid line solenoid valve 40 and travels through a first liquid line 14 to expansion mechanism 50. Expansion mechanism 50 may comprise a valve, orifice or other possible expansion apparatus known to those of ordinary skill in the art. The expansion mechanism 50 causes a pressure drop in the refrigerant, as the refrigerant passes through the mechanism.

Upon leaving the expansion mechanism, the refrigerant travels through second liquid line 16, arriving at evaporator 60, which comprises a heat exchanger coil. Refrigerant passing through evaporator 60 absorbs heat from the environment to be cooled. Specifically, air from the environment to be cooled circulates through evaporator coil, where it is cooled by heat exchange with the refrigerant. Refrigerant carrying the heat extracted from the environment then returns to compressor 20 by suction line 18, completing the refrigeration cycle.

The precision cooling systems, such as that outlined above for a computer or telecommunications room, are typically operated year round, even when the outdoor ambient temperature is below 40° F. Certain operating conditions produce a high head pressure within the cooling system 10 and particularly in discharge line 12. As a result, high head pressure switch 24 shuts down compressor 20 if the discharge pressure exceeds a predetermined level. In particular, when the environment in which the condenser is situated is 30° F. or cooler than the environment in which the evaporator is situated (i.e., the environment to be cooled), condenser 30 is significantly cooler than the evaporator.

With the cooling system 10 shut down for an extended period of time, refrigerant is in liquid line expands through evaporator 60 and draws through compressor 20. The refrigerant then condenses in the cold condenser 30. The condenser fills with liquid refrigerant, and refrigerant may begin to condense in discharge line 12 and compressor 20. Starting compressor 20 with liquid refrigerant present in the discharge line 12 and/or the discharge volume of compressor 20 is likely to cause pressure excursion incidents. Condensation-induced shock (CIS) and vapor-propelled liquid slugging (VPLS) are phenomena that can produce dangerous high-pressure excursion incidents in the discharge lines.

To describe the occurrence of CIS and VPLS, operation of cooling system 10 is described after refrigerant has migrated from the liquid lines and condensed in the discharge line 12 and/or discharge volume of compressor 20. During start up of compressor 20, the refrigerant mass flow rate may increase from zero to the normal operating conditions in less than 10 seconds. To transfer momentum to the liquid in discharge line 12, the refrigerant vapor being pumped by compressor 20 undergoes a pressure surge.

Any volume of liquid in discharge line 12 decreases the volume available for the vapor from compressor 20. The less vapor volume available to absorb the pressure surge, the greater is the peak of the pressure surge to provide the necessary transfer of momentum. The condensation in line 12 or the discharge volume of compressor 20 induces a shock or pressure surge. If the vapor discharge volume is too small at startup, the peak of the pressure surge will exceed the predetermined setting of high head pressure switch 24 (which is chosen to prevent damage to the components of the cooling system).

High head pressure switch 24 will trip and shut down compressor 20. Multiple attempts to restart cooling system 10 will eventually result in successful operation. With repeated starts of the compressor, the liquid slugging the line is eventually propelled by the vapor along the line 12, and the volume available to the vapor increases. In other words, the liquid condensate in discharge line 12 can be forced through the line, allowing for enough volume in the discharge line to accommodate the compressed vapor without tripping high head pressure switch 24.

Field reports indicate high-pressure pulses in discharge line 12 in close proximity to the location of pressure switch 24. In some cases this pulse is high enough to peg and bend the needle on the gauge used to perform the measurement. Therefore, damage and wear to compressor 20 and other components of cooling system 10 can result from repeated occurrences of the high head pressure at startup.

It is to be understood that the formation of high-pressure excursion incidents can result from a number of other factors or conditions not listed herein. Furthermore, those conditions cited in the present disclosure as contributing to the possible occurrences of high-pressure excursion incidents may vary with the given design characteristics or installation conditions of a cooling system. The conditions cited are presented as exemplary of those conditions that may lead to high-pressure excursion incidents for a given cooling system in a conventional field setting.

One prior art solution to the refrigerant migration and condensation problem is to move liquid line solenoid valve 40 from the outdoor unit, i.e., condenser unit 30, to the other end of the liquid line 14 just ahead of expansion mechanism 50. Adding a liquid line solenoid valve to all evaporator units in production would prove costly. The circumstances associated with high-pressure excursion incidents as discussed herein occur in only a few installations of cooling system. Furthermore, the problems associated with liquid line slugging and high head pressures at startup are not usually discovered until after installation of a cooling system. Moving or inserting a liquid line solenoid 40 to just ahead of the expansion valve 50 involves a complicated retrofitting procedure. Typically, the procedure involves cutting the liquid line 14 and installing the liquid line solenoid 40 in the new location 42, which can be cost prohibitive.

The present invention is directed to overcoming, or at least reducing the effects of, one or more of the problems set forth above.

SUMMARY OF THE INVENTION

In view of the foregoing and other considerations, the present invention relates to the application of one or more heaters to a cooling circuit to prevent condensed refrigerant from migrating into the discharge line and/or discharge volume of a compressor.

In accordance with one aspect of the present invention, there is provided a cooling system that includes a first and a second discharge section. The first discharge section includes a discharge volume of a compressor. The second discharge section includes a discharge line, where the discharge line runs from the discharge volume of the compressor to a condenser. The cooling system includes a heating element in thermal communication with at least one of the discharge sections.

In accordance with another aspect of the present invention, there is provided a cooling system. The cooling system includes a first means for collecting a discharge volume of a compressor and includes a second means for communicating the discharge volume of the compressor to a condenser. The cooling system includes a third means for applying heat to at least one of the first or second means.

In accordance with another aspect of the present invention, there is provided a compressor. The compressor includes a discharge section on the compressor and a heating element in thermal communication with the discharge section.

In accordance with another aspect of the present invention, there is provided a method for preventing high-pressure excursion incidents in a cooling system. The method includes the step of heating a compressor discharge volume of the cooling system.

In accordance with a further aspect of the present invention, the method further includes the step of heating a discharge line of the compressor.

In accordance with another aspect of the present invention, there is provided a cooling system having steps for preventing high-pressure excursion incidents in the cooling system. The cooling system includes steps for heating a compressor discharge volume of the cooling system.

In accordance with a further aspect of the present invention, the cooling system further includes steps for heating a discharge line of the compressor.

BRIEF DESCRIPTION OF THE DRAWINGS

The foregoing, the preferred embodiment, and other aspects of the present invention will be best understood with reference to the detailed description of specific embodiments of the invention, which follows, when read in conjunction with the accompanying drawings, in which.

Figure 1:
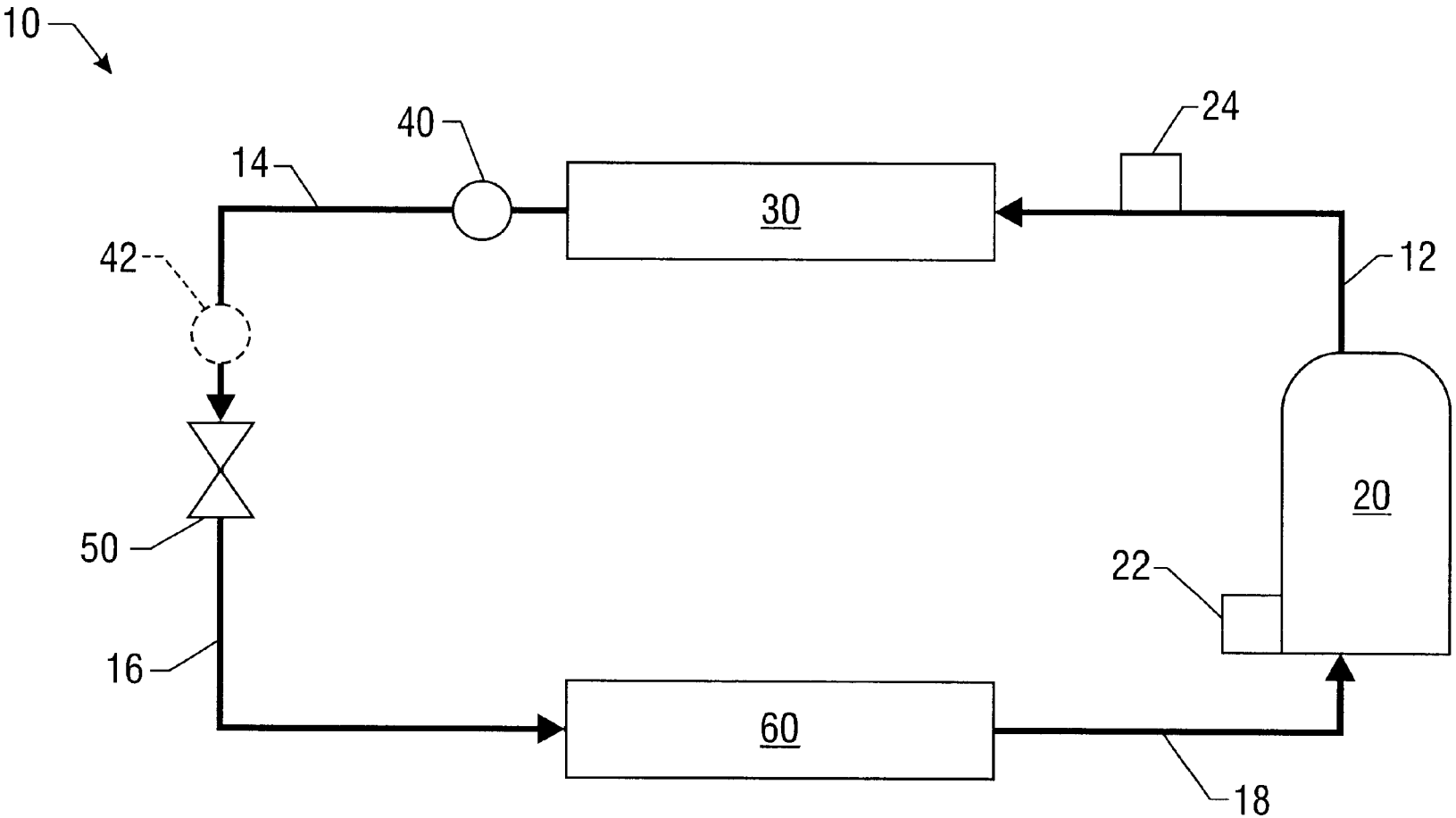
FIG. 1 (Prior Art)
FIG. 1 is a schematic diagram of a cooling system according to the prior art.

While the present invention is susceptible to various modifications and alternative forms, specific embodiments are shown by way of example in the drawings and are described in detail herein. However, it should be understood that the invention is not limited to the particular forms disclosed. Rather, the invention includes all modifications, equivalents and alternatives within the scope of the appended claims.

DETAILED DESCRIPTION OF THE INVENTION

Figure 2:
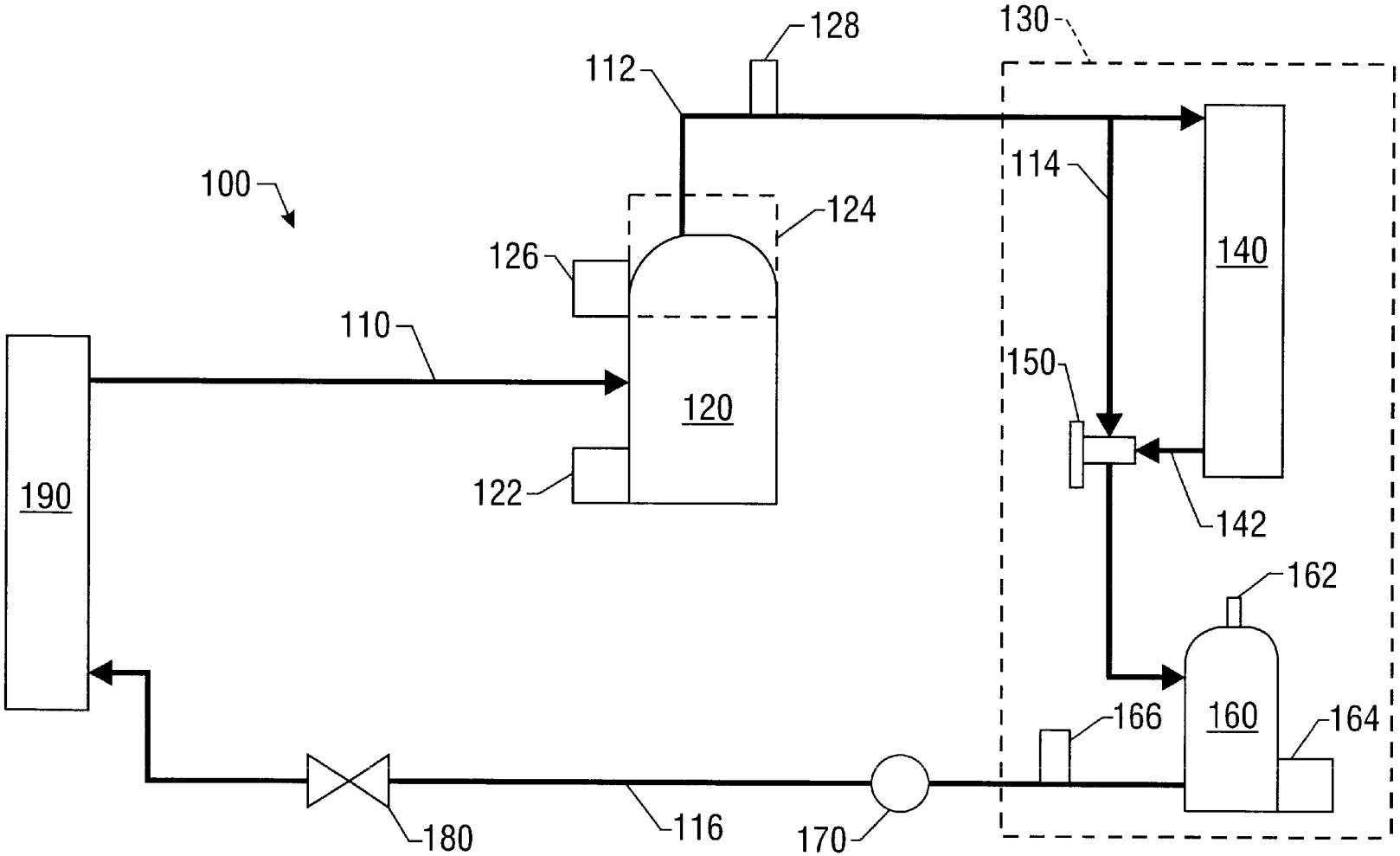
FIG. 2 is a schematic diagram of a cooling system in accordance with the present invention.

Illustrative embodiments will now be described with reference to the accompanying Figures. FIG. 2 is a schematic diagram of a cooling system 100 in accordance with the present invention. Cooling circuit 100 includes compressor 120, condenser 140, expansion mechanism 180 and evaporator 190. Refrigerant used in cooling circuit 100 may be any chemical refrigerant, including chloroflourocarbons (CFCs), hydroflourocarbons (HFCs), or hydrochloroflourocarbons (HCFCs) such as R-22.

Refrigerant enters compressor 120 through suction line 110. Compressor 120, which may be a reciprocating compressor, a scroll compressor, or other compressor type known to those of ordinary skill in the art, compresses the refrigerant. Compressor 120 is equipped with a crankcase heater 122, which heats the compressor oil sump to prevent refrigerant condensation in the compressor oil during compressor off cycles. Compressor 120 also includes discharge section 124, where compressed refrigerant is collected and discharged through discharge line 112. A heater 126 is located at discharge section 124 of compressor 120. Further details concerning the function of heater 126 are included below.

After the refrigerant is compressed, it travels through discharge line 112 to which high-pressure switch 128 is connected. High-pressure switch 128 protects cooling system 100 from damaging high pressures that may occur upon startup or during operation of the cooling system. Refrigerant exiting discharge line 112 enters condenser unit 130. The condenser unit includes condenser 140, which is a heat exchanger coil. In the condenser, heat from the refrigerant is dissipated to an external heat sink, i.e., an outdoor environment.

For the present, a detailed description of the components of condenser unit 130 is omitted. Upon leaving condenser unit 130, refrigerant continues through liquid line 116 and liquid line solenoid valve 170. Liquid line solenoid valve 170 is closed during off cycles to prevent refrigerant migration past the valve. The refrigerant then passes through expansion mechanism 180, which may be a valve, orifice, or other expansion apparatus, which are well known to those of ordinary skill in the art. Expansion mechanism 180 subjects passing liquid refrigerant to a drop in pressure.

Exiting expansion mechanism 180, refrigerant reaches evaporator 190, which comprises a heat exchanger coil. Refrigerant passing through evaporator 190 absorbs heat from the environment to be cooled. Air from the environment to be cooled is circulated through evaporator coil, and is cooled by heat exchange with the refrigerant. Upon leaving evaporator 190, refrigerant carrying the heat extracted from the environment returns to compressor 120 by suction line 110, thereby completing the cooling cycle.

Cooling system 100 may be operated year round, even when the outdoor ambient temperature is approximately 30° F. or more below the indoor ambient temperature of the space to be cooled. For example, a typical indoor ambient temperature is about 70° F. In which case, cooling system 100 may be operated when the outdoor ambient temperature is about 40° F. With these conditions, condensing unit 130 is significantly cooler than evaporator 150. To maintain adequate head pressure within condensing unit 130, the capacity of condenser 140 must be reduced or restricted. The condensing unit 130 includes components for flooding condenser 140 with liquid refrigerant to maintain head is pressure. The components are 3-way head pressure control valve 150, receiver 160, heater 164, and heater pressure switch 166. The operation of these components is as follows.

Pressure line 114 connects discharge line 112 to 3-way pressure control valve 150. Condenser 140 includes port 142 that connects to 3-way pressure control valve 150. Pressure control valve 150 operates to maintain a minimum condensing pressure in condenser 140. Upon leaving pressure control valve 150, refrigerant is collected in receiver 160, which includes pressure relief valve 162 and heater 164. Receiver 160 aids in maintaining the condensing pressure in condenser 140 during low ambient temperature conditions.

Head pressure control valve 150 operates to maintain a minimum condensing pressure within condenser 140. During low temperature operation, 3-way control valve 150 meters discharge gas into receiver 160 to maintain a discharge pressure operating against the dome of 3-way control valve 150. The discharge pressure at valve 150 closes condenser port 142, backing liquid refrigerant into condenser 140. The presence of liquid refrigerant in condenser 140 reduces the condenser working volume. Receiver 160 is sized to hold the excess refrigerant that would otherwise flood condenser 140.

Heater 164 on receiver 160 is temperature compensated. Heater 164 maintains the liquid refrigerant pressure within a specific range during off-cycles. Liquid pressure switch 166 turns heater 164 off during operation of the cooling system and/or when the pressure in receiver 160 is high. Heater pressure switch 166 may have a cut out of about 150 psig (1034 kPa) and a cut in of about 100 psig (690 kPa). For safety, the dome of receiver 160 includes a pressure relief valve 162 that may be set for about 450 psig (3103 kPa).

In low temperature conditions, the condenser will be only partially charged with refrigerant, and installations with significantly long liquid lines 116, e.g., over 50 ft., may have as much or more refrigerant in liquid line 116 than in condenser 140. This results in migration of refrigerant and the possibility of pressure excursion incidents as described in detail below.

During off cycles, condenser 140 will be the coldest part of cooling system 100 because of the low outdoor temperature. This results in a higher pressure in liquid line 116 than in condenser 140. For example, assuming evaporator 190 is at the indoor temperature of 70° F. and condenser 140 is at the outdoor temperature of 40° F., the pressure in liquid line 116 may be as much as 50 psig greater than the pressure in condenser 140. This pressure differential will induce refrigerant migration from liquid line 116. Refrigerant expands through evaporator 190 and draws through suction line 110 and compressor 120, finally condensing to liquid in condenser 140.

During a prolonged off-cycle, condenser 140 fills with liquid refrigerant due to this migration. Refrigerant may also condense in discharge line 112 and eventually in discharge section 124 of compressor 120. If liquid refrigerant is present in discharge line 116 and/or discharge section 124, transient high pressures will occur when compressor 120 is started. Condensation-induced shock (CIS) and vapor-propelled liquid slugging (VPLS) produce these dangerous pressure excursions, which can cause significant damage to the cooling system.

To prevent pressure transients, it is necessary to prevent or minimize refrigerant migration and condensation in discharge line 112 and discharge section 124. Applying a heater 126 to discharge section 124 provides one solution to prevent condensation in discharge section 124 of compressor 120. Heater 126 may be a heater such as would be placed in thermal communication with the crankcase and may be mounted to the compressor top cap or dome. The compressor top cap or dome forms the discharge volume of the compressor, where pressurized vapor is first collected from the compression mechanism, be it a scroll or piston. Alternatively, heater 126 may be a flexible strip heater attached to discharge line 112 immediately adjacent to compressor 120.

It is preferred to use only the heater attached to the compressor dome between the top plate and the top cap. Applying a heater to this location resembles the use of a heater on the crankcase of the compressor and is, therefore, easy to implement. Furthermore, the heater may be applied after a cooling system is installed and found to require prevention of high-pressure excursions. Thus, application of the heater according to the present invention, in the form of a kit or retrofitting package, obviates the need to modify all cooling systems before installation, which may be costly or may not require the prevention of high-pressure excursions.

Addition of heater 126 may eliminate the need to move the location of the liquid line solenoid to just upstream to expansion mechanism 180, as described above. Furthermore, addition may completely eliminate the need for liquid line solenoid valve 170 altogether. Heater 126 may be powered continuously, as is normal practice for crankcase type heaters 122 used to prevent refrigerant condensation in the compressor oil sump.

Figure 3:
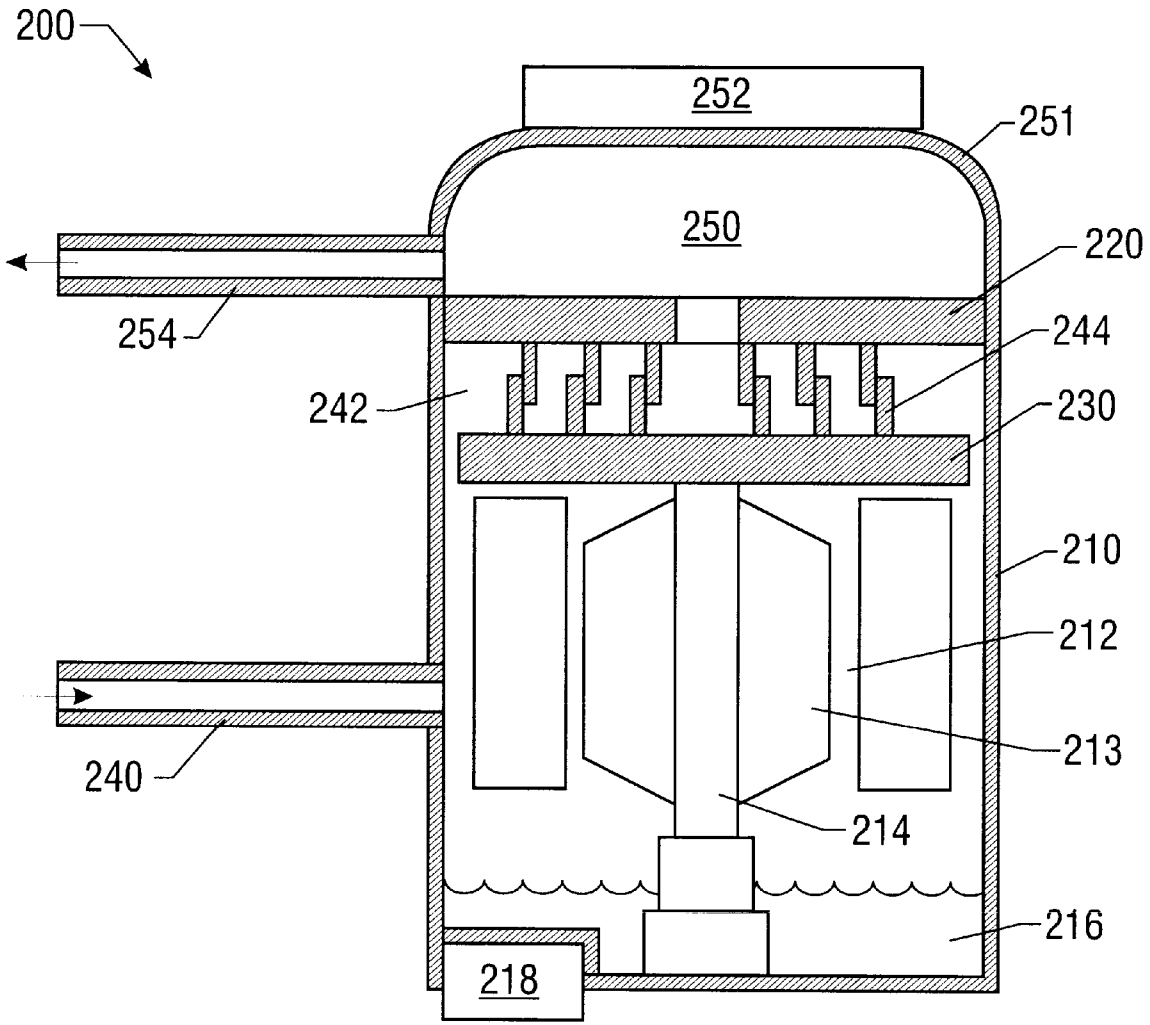
FIG. 3 illustrates a compressor according to the present invention.

FIG. 3 illustrates a sectional view of a compressor having additional heaters installed according to the present invention. Scroll compressor 200 is shown in isolation. For simplicity, the known prior art means for motor cooling, lubrication, thermal overload protection, refrigerant filtration, and for refrigerant flow, pressure, and temperature control are not shown. Scroll compressor 200 includes hermetically sealed enclosure 210. Within enclosure 210 is an electric motor 212 having a rotor 213 and extended shaft 214. Extended shaft 214 drives compression spiral 230.

Scroll compressor 200 includes two spiral-shaped members 220, 230. Members 220, 230 fit together forming a plurality of crescent-shaped gas pockets. Compression spiral 230 orbits within stationary scroll 220. Refrigerant enters enclosure 210 through low-pressure intake 240. When extended shaft 214 rotates by operation of electric motor 212, orbiting spiral 230 forms pockets of gas with stationary spiral 220. Orbiting spiral 230 continuously forces and presses the gas pockets against the inside surface of stationary scroll 220 so that sealed compartments 244 are formed. Sealed compartments 244 undergo a continuous decrease in volume. Consequently, the gas pressure increases starting from a low pressure chamber 242 at the outside of the spiral and ending at the high-pressure chamber at compressor discharge volume 250. The vapor is then discharged through high-pressure discharge 254.

Scroll compressor 200 is equipped with a crankcase heater 218 to prevent refrigerant condensation in oil sump 216 during off-cycles. This is particularly desirable when the compressor will be operated in a relatively cold environment, as the cold ambient air will condense the refrigerant, which will then dilute the oil. The presence of condensed refrigerant in the oil reduces its lubricating capabilities. A typical crankcase heater 218 is band heater that encompasses the compressor enclosure near oil sump 216. It is desirable to heat oil sump 216 to vaporize any condensed refrigerant accumulated in oil sump 216.

In accordance with the present invention, a second heater 252 is placed in thermal communication with vapor discharge volume 250 of the compressor. The second heater may be similar in construction to the band heater placed in thermal communication with oil sump 216. A band heater has a plurality of coils formed in a band. Current is supplied to the coils, and the electrical resistance of the coils generates heat. The band heater may be placed in thermal communication with a surface that conducts heat, such as the dome of a scroll compressor. The heat generated by the coils conducts through compressor dome 251 and heats the area of vapor discharge volume 250 of the compressor.

Heater 252 maintains the vapor discharge volume 250 at a temperature that prevents refrigerant condensing to liquid within discharge volume 250. Heater 252 may be operated continuously, even while the compressor is running without detrimental effect on the operational characteristics of compressor 200. The amount of power supplied by the heater is typically in the range of 70 W, and this additional heat is negligible, when compared to the energy added to the refrigerant by the compressor. Heater 252 may add no more than 2° F. to the discharge temperature. Thus, the heater may operate continuously.

Figure 4:
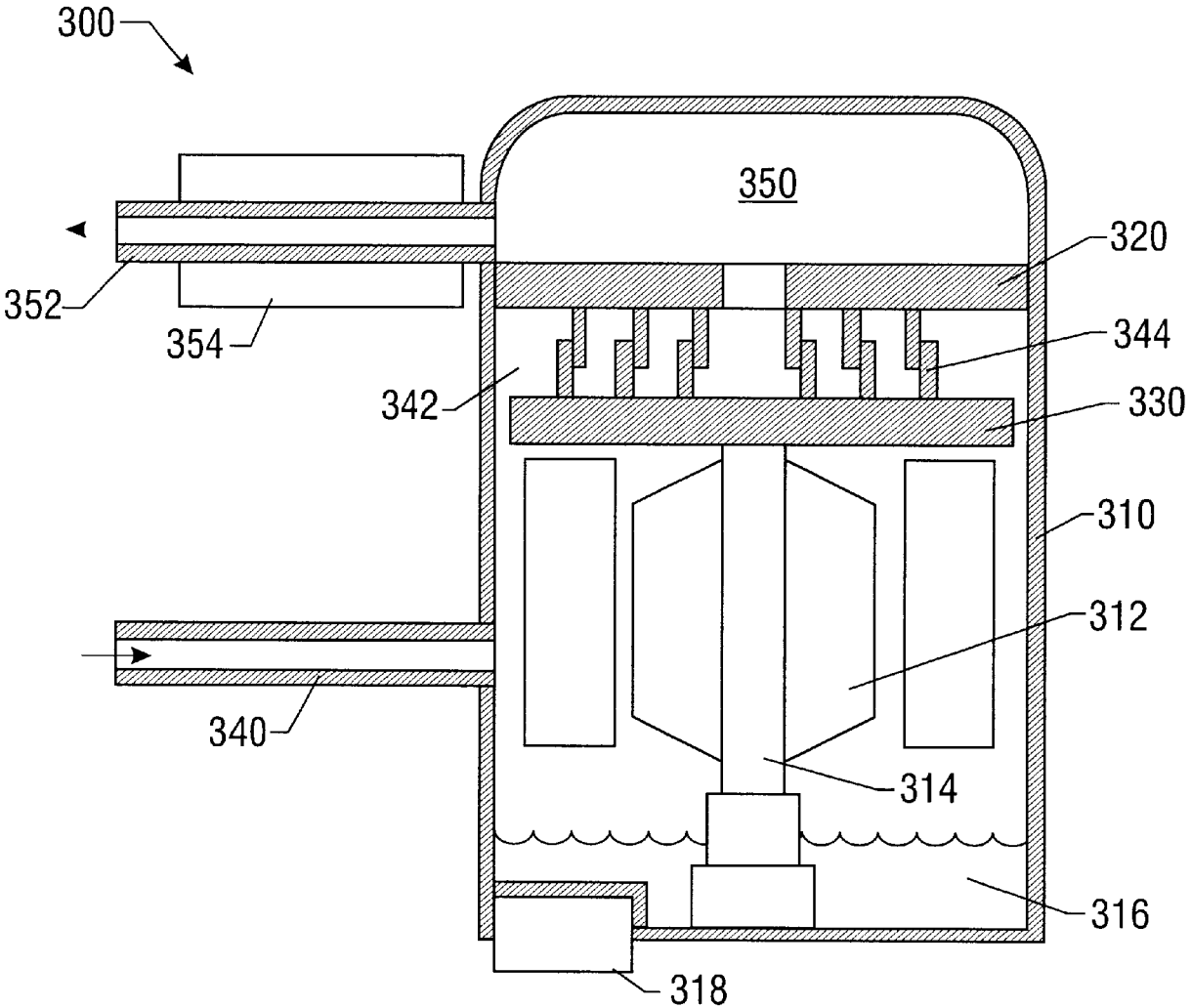
FIG. 4 illustrates another compressor according to the present invention.

Alternatively, as illustrated in FIG. 4, a heater 354 may be placed in thermal communication with vapor discharge line 352 of compressor 300. Heater 354 may be a flexible strip heater placed in thermal communication with discharge line 352. It is preferable that heater 354 and discharge line 352 be enclosed within the tubular insulation for the refrigerant line. The insulation provides protection to the heater and acts to concentrate the application of heat to the discharge line. Heater 354 maintains the temperature of discharge line 352 above a temperature at which refrigerant will condense into a liquid. Heater 354 may run continuously, even while compressor 300 is running. The heat from second heater 352 has no detrimental effect on the operating characteristics of compressor 300. The resulting heat applied to the system while the compressor is in operation is negligible and changes the discharge temperature by only a few degrees.

Figure 5:
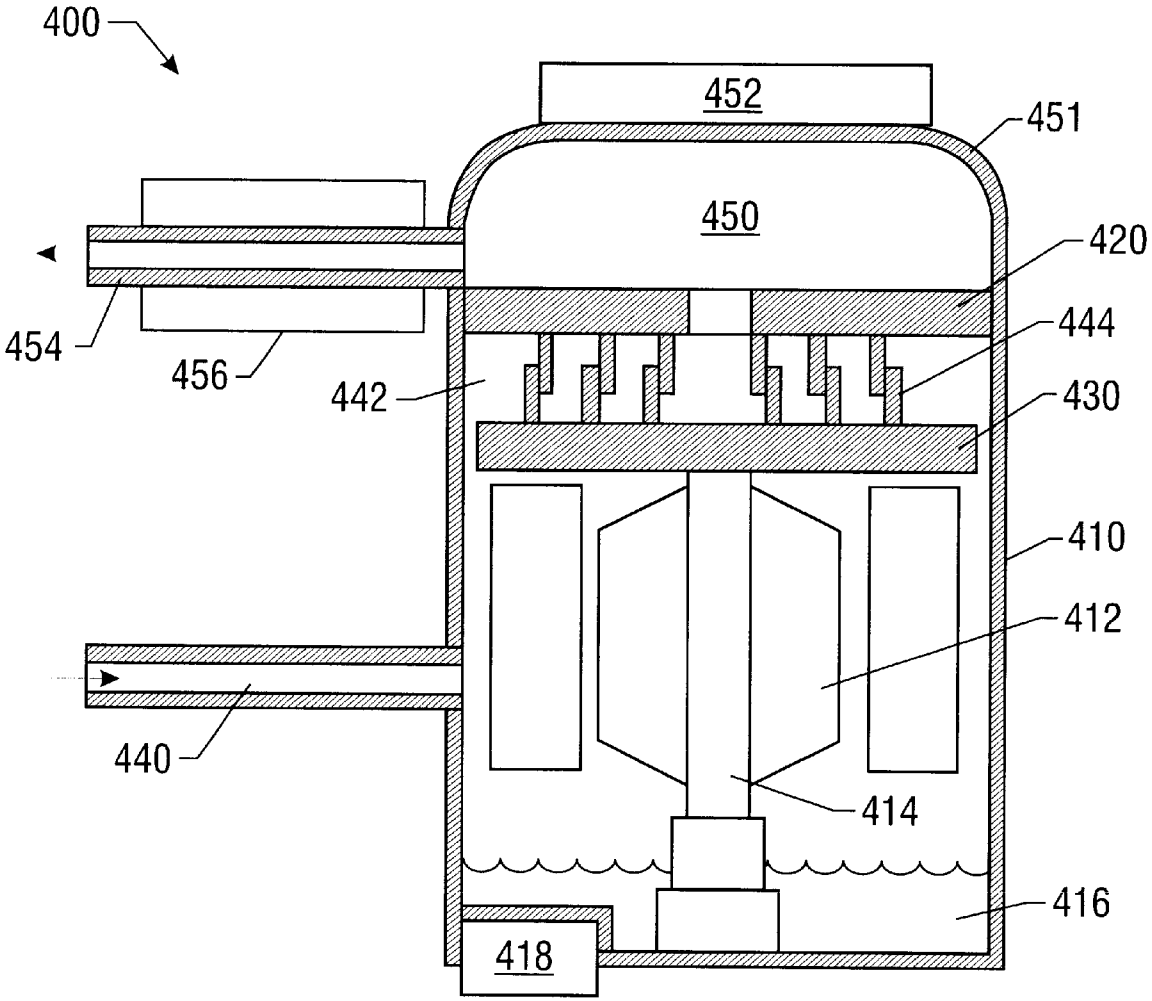
FIG. 5 illustrates yet another compressor according to the present invention.

In yet another alternative, shown in FIG. 5, a heater 452 may be placed in thermal communication with vapor discharge volume 450 of compressor 400. Heater 452 maintains vapor discharge volume 450 above a temperature at which refrigerant will condense into a liquid in volume 450. Additionally, a third heater 456 is placed in thermal communication with high-pressure discharge line 454. Third heater 456 may be a flexible strip heater placed in thermal communication with the discharge line 454. Heater 456 and discharge line 454 are preferably enclosed within the tubular insulation for refrigerant line. Heaters 452 and 456 may run continuously, even while the compressor is running, as the additional heat produced by heaters 452 and 456 has no detrimental effect on compressor operation. The additional heat applied while the compressor is operating is negligible because it increases the discharge temperature by only a few degrees.

Figure 6:
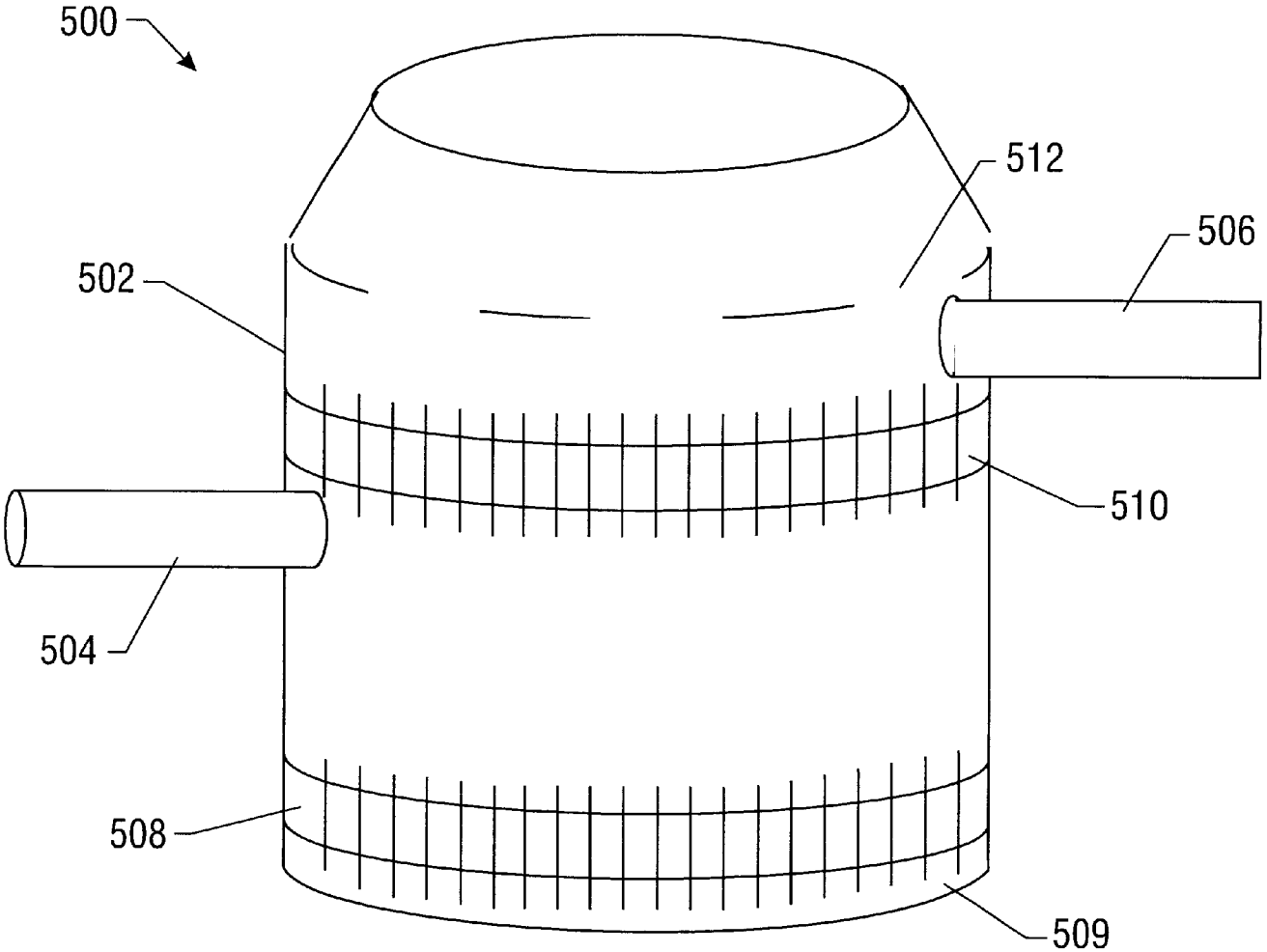
FIG. 6 is an exterior view of a compressor according to the present invention.

FIG. 6 illustrates an exterior view of a compressor with discharge heaters installed according to the present invention. Compressor 500 has an enclosure 502. Within enclosure 502 are an electric motor, a compression mechanism and other necessary components (not shown). A suction line of the cooling system (not shown) connects to enclosure 502 via an intake line 504. Uncompressed refrigerant enters the enclosure through intake line 504 to be compressed by compressor 500. Once compressed, the refrigerant leaves compressor 500 through a discharge line 506, which then connects to a discharge line of the cooling system (not shown).

Compressor 500 includes crankcase heater 508 encircling enclosure 502 of compressor 500. The crankcase heater is a band heater that heats the oil in the oil sump of enclosure 502. In addition to this crankcase heater 508, the compressor includes a second heater 510 encircling enclosure 502 of the compressor. Second heater 510 is also a band heater as is used to heat the oil sump. Heater 510 encircles the enclosure around the top cap or dome 512 of the compressor.

The band heaters 508 and 510 have a plurality of coils formed in a band or circular belt. Current is supplied to the coils, and the electrical resistance of the coils generates heat. The band heaters 508, 510 are applied directly to the surface of enclosure 502. The heat generated by the coils of heaters 508, 510 conducts through the material of enclosure 502 and heats the area of oil sump 509 and top cap 512, respectively.

Top cap 512 contains the discharge volume or chamber, where compressed refrigerant is first collected after compression before leaving enclosure 502. Second heater 510 prevents condensation of refrigerant in the discharge volume in top cap 512. It is within capabilities of one of ordinary skill in the art to estimate and/or calculate the heater size required to sufficiently heat top cap 512 and prevent refrigerant condensation in the discharge volume.

Figure 7:
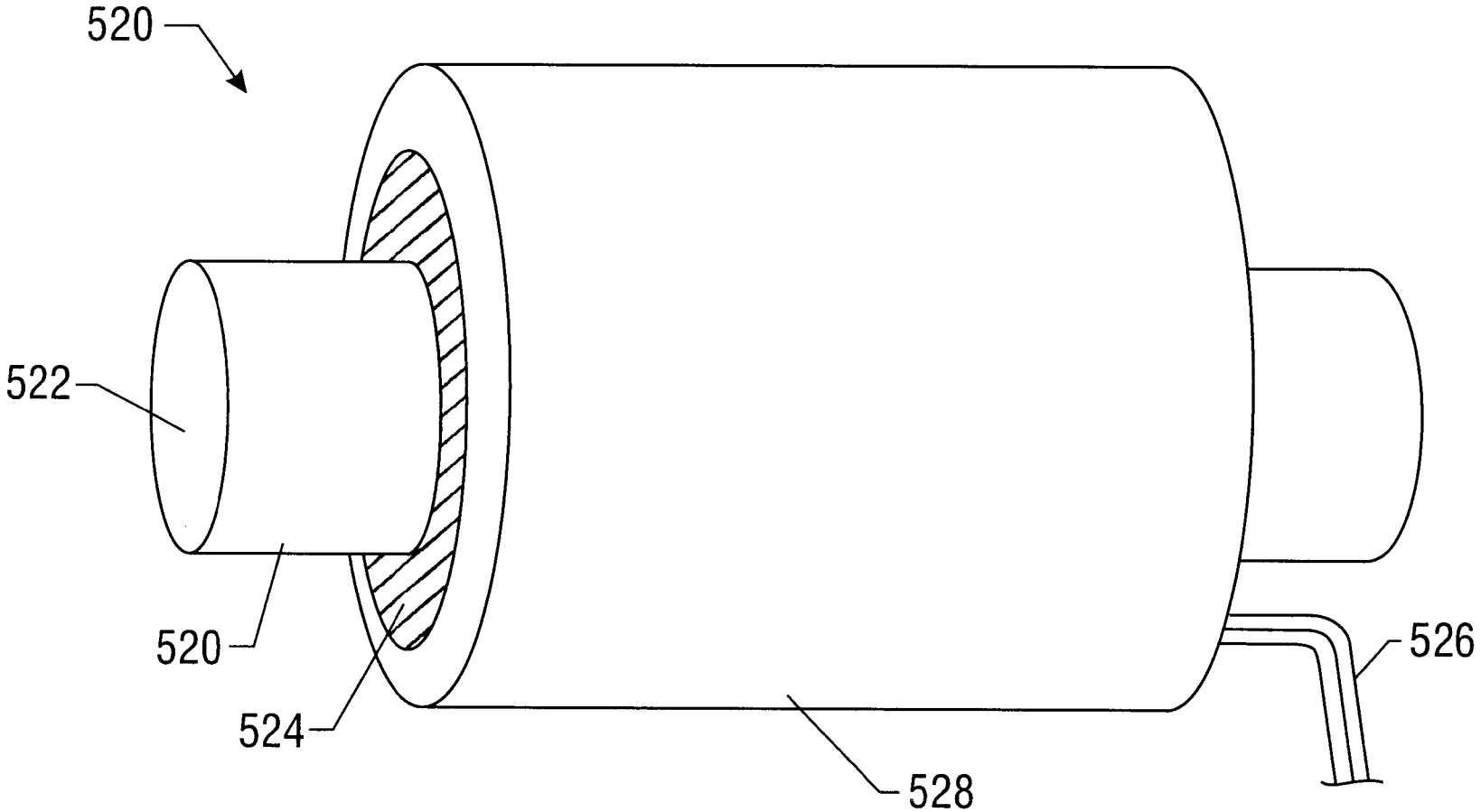
FIG. 7 illustrates a discharge line having a heating element in accordance with the present invention.

FIG. 7 illustrates discharge line 520 having a heating element installed according to the present invention. Discharge line 520 is a high-pressure line that connects to a compressor (not shown) at end 522. Compressed refrigerant leaving the compressor enters end 522 of discharge line 520 and travels along its length. A heater 524 is disposed around the discharge line 522. Ideally, heater 524 is immediately adjacent to the compressor. The heater and the discharge line are enclosed by refrigerant line insulation 528.

Figure 8A:
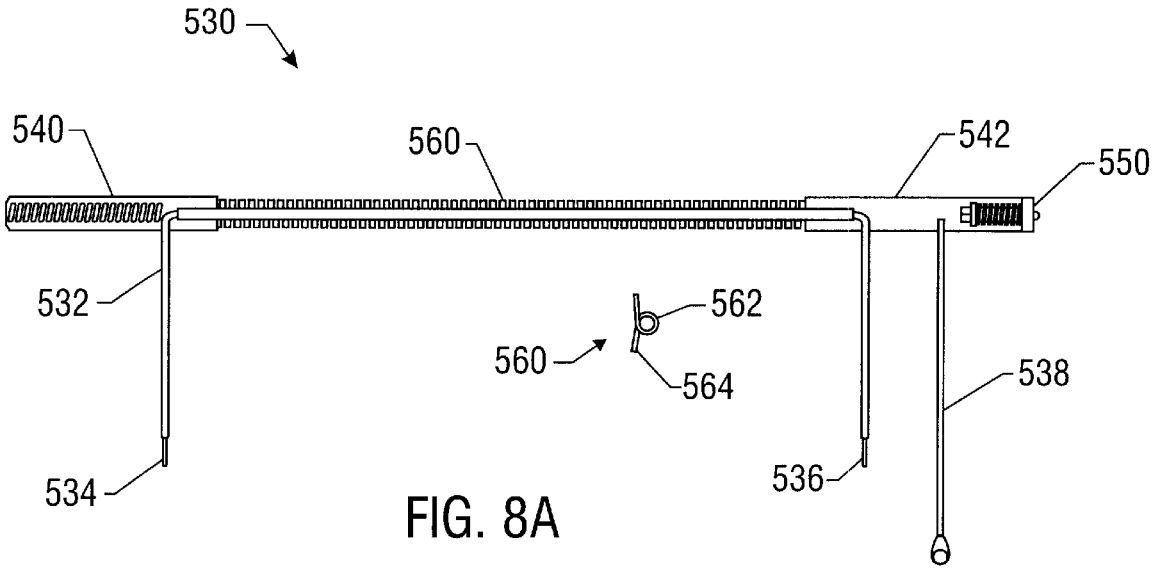
FIGS. 8A–B illustrate an embodiment of a heater according to the present invention that may be used to retrofit an installed cooling system in order to prevent high-pressure excursion incidents as discussed herein.

FIG. 8A illustrates an embodiment of a heater 530 that may be used to retrofit an installed cooling system in order to prevent high-pressure excursion incidents as discussed herein. The heater resembles a crankcase heater such as provided by the Copeland Corporation. Heater 530 defines a band heater having a conductive wire 532. The wire has wire leads 534, 536. Electrical current passing through wire 532 creates heat due to resistance of the wire. A first portion 540 of a mounting bracket attaches to one end of wire 532. A second portion 542 of a mounting bracket attaches to the other end of wire 532. Second portion 542 includes a snap lock 550 for connecting first portion 540 to second portion 542. A ground wire 538 may also be attached to band heater 530 for safety. A series of tags 560 situate along the length of conductive wire 532. A detail of a tag 560 is shown in a cross section A—A of FIG. 8A. The tags include a ring 562 that wraps around wire 532 and deflecting ends 564 that contact a surface (not shown) such as a compressor dome.

Figure 8B:
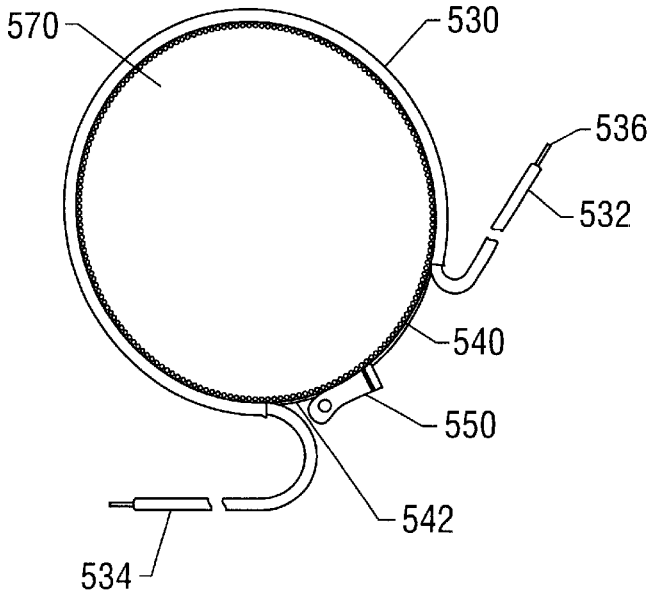

FIG. 8B illustrates the attachment of the band heater 530 of FIG. 8A to a compressor dome 570 according to the present invention. Conductive wire 532 bends around the contour of compressor dome 570. Wire leads 534, 536 bend in appropriate directions for attachment to electrical wiring. Snap lock 550 connects first portion 540 and second portion 542 of the mounting bracket to hold the band heater in place on the compressor dome 570. Wire ends 534, 536 may be provided with quick connectors (not shown) and conductive wire 532 may be sheathed with a metal protector (not shown).

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

What is claimed is:

1. A cooling system, comprising:

a compressor having a discharge volume;

a discharge line connecting said discharge volume to a condenser; and a heating element in thermal communication with said discharge volume or said discharge line.

2. The cooling system of claim 1, wherein said heating element is in thermal communication with said discharge volume of said compressor.

3. The cooling system of claim 2, wherein a second heating element is in thermal communication with said discharge line.

4. A cooling system, comprising:

means for compressing refrigerant, said means for compressing having a discharge volume;

a discharge line connecting said discharge volume to a condenser; and means for heating either said discharge volume or said discharge line.

5. The cooling system of claim 4, wherein said means for heating is in thermal communication with said discharge volume.

6. The cooling system of claim 5, further comprising means for heating said discharge line.

7. A compressor for use in a cooling system operated when an ambient temperature around a condenser of said system is an ambient temperature around an evaporator of said system, said compressor comprising:

a discharge section; and a heating element in thermal communication with said discharge section.

8. A method for preventing high-pressure excursion incidents in a cooling system, said cooling system having a compressor discharge volume and a discharge line connecting said discharge volume to a condenser, said method comprising heating said compressor discharge volume.

9. The method of claim 8, further comprising heating said discharge line of said compressor.

10. A method for use with a cooling system operated when condensing unit ambient temperatures are less than evaporator ambient temperatures, comprising a step for preventing high-pressure excursion incidents in said cooling system by heating a discharge volume of a compressor.

11. The cooling system of claim 10, further comprising a step for preventing high-pressure excursion incidents in said cooling system by heating a discharge line of said compressor.

* * * * *